US008955443B1

(12) United States Patent
Miller

(10) Patent No.: US 8,955,443 B1
(45) Date of Patent: Feb. 17, 2015

(54) WARHEAD HAVING SELECTABLE AXIAL EFFECTS

(75) Inventor: Clayton W. Miller, Reading, MA (US)

(73) Assignee: Textron Systems Corporation, Wilmington, MA (US)

( * ) Notice: Subject to any disclaimer, the term of this patent is extended or adjusted under 35 U.S.C. 154(b) by 160 days.

(21) Appl. No.: 13/604,887

(22) Filed: Sep. 6, 2012

(51) Int. Cl.
*F42B 12/02* (2006.01)
*F42B 12/10* (2006.01)
*F42B 12/24* (2006.01)
*F42B 12/58* (2006.01)

(52) U.S. Cl.
USPC ..... 102/475; 102/476; 102/489; 102/492; 102/493; 102/331; 102/393

(58) Field of Classification Search
USPC ..... 102/475, 476, 489, 491, 492, 493, 305, 102/306, 307, 308, 309, 310, 320, 331, 332, 102/393
See application file for complete search history.

(56) References Cited

U.S. PATENT DOCUMENTS 3,960,085 A 6/1976 Abernathy et al.
5,377,594 A * 1/1995 Alford ..... 102/308
7,007,607 B1 * 3/2006 Fong et al. ..... 102/489
8,091,482 B2 * 1/2012 Rotkopf ..... 102/475
2003/0177933 A1 * 9/2003 Fortner et al. ..... 102/476
2005/0126420 A1 * 6/2005 Givens et al. ..... 102/310

OTHER PUBLICATIONS

BLU-108/B Submunition; http://www.globalsecurity.org/military/systems/munitions/blu-108.htm; Mar. 5, 2013; Copyright © 2000-2013; GlobalSecurity.org; All rights reserved; Site maintained by: John Pike; Page last modified: Jul. 7, 2011 02:50:29 ZULU, pp. 1-4.

* cited by examiner

*Primary Examiner* — James S Bergin
(74) *Attorney, Agent, or Firm* — BainwoodHuang

(57) ABSTRACT

A cylindrical warhead is divided into a conical central segment and peripheral segments. The central segment has a disk-shaped liner bounding a cavity with high explosive and forming a penetrating projectile. The peripheral segments are hingedly attached to the central segment and have outer segment faces bounding respective cavities with high explosive, the segment faces forming sidewalls of the warhead in a closed position. The peripheral segments can be released to an open position in which the segment faces point in the forward direction for detonation. The warhead may be used in the closed position for single hardened targets such as armored vehicles and in the open position for area targets such as lighter vehicles and personnel. Opening of the warhead may be enabled at a time of launch of the warhead, or at a time of target acquisition after launch.

17 Claims, 3 Drawing Sheets

WARHEAD HAVING SELECTABLE AXIAL EFFECTS

BACKGROUND

The present invention is related to the field of explosive warheads, and in particular to air-delivered tactical warheads used against ground targets such as vehicles and personnel.

Warheads of the type known as explosively formed penetrators or EFPs are generally known. In one type of EFP, a liner closes one end of a cylindrical body filled with high explosive. The liner is of a relatively dense and low-yield material such as copper. Upon detonation, the liner forms an elongated, high-velocity slug capable of penetrating steel vehicle bodies and other relatively hard target objects. In some cases the liner has patterning to promote a desired pattern of fragmentation, such as to form a ring of smaller projectiles or "p-charges" about a central EFP slug. The smaller projectiles are effective against lighter vehicles, other ground-based equipment, and personnel.

SUMMARY

The effectiveness of air-delivered tactical warheads can be improved by features providing for altering the warhead configuration depending on the type of target, specifically depending on whether the target is primarily an armored vehicle or similar single hardened target or primarily a collection of lighter vehicles and/or personnel in a small area. For a single hardened target, a configuration maximizing the power of an EFP slug can be used, while for area targets a configuration maximizing forward-directed fragmentation can be used. The selection may be made dynamically based on the characteristics of targets as they are pursued or encountered, either by human user input or by automatic action of target acquisition electronics carried by the warhead.

A disclosed warhead has a generally cylindrical shape and is divided into a conical central segment and a plurality of peripheral segments surrounding the central segment. The central segment has a disk-shaped liner at a front end, the liner bounding a cavity of the central segment filled with high explosive and configured to form one or more high-speed projectiles in a forward direction upon detonation of the high explosive. In one embodiment the liner is configured to form an EFP slug, and may also include separate smaller p-charges for lighter targets in the area of an armored vehicle or similar hardened target. The peripheral segments are hingedly attached to the central segment about the liner at the front end. Each peripheral segment has an outer segment face bounding a cavity of the peripheral segment filled with high explosive, and the segment faces of the peripheral segments form sidewall portions of the warhead when the peripheral segments are in a closed or folded position. The peripheral segments are operable to be released from the folded position to an open position in which the segment faces are pointed in the forward direction for detonation. A detonator initiates simultaneous detonation of the high explosive of the central and peripheral segments.

The warhead may be used in the closed position, in which case the explosions of the peripheral segments provide confinement for the explosive of the central segment, resulting in maximized energy imparted to the EFP slug formed by the liner (as well as any separate p-charges from the liner if present). In this use the result is similar to that of the conventional EFP warhead. The warhead may also be used in the open position, in which case the fragments formed from the outer walls of the peripheral segments are directed forward toward area target(s), adding to the destructive effect of the EFP slug and any p-charges formed by the liner. In one embodiment, the manner of use is selectable, enabling flexible deployment based on specific target types. For example, the opening of the warhead may be enabled at a time of launch of the warhead, or at a time of target acquisition after launch. Thus a single warhead type can be carried in the field and used in a flexible manner to support different missions and tactical situations.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Figure 1:
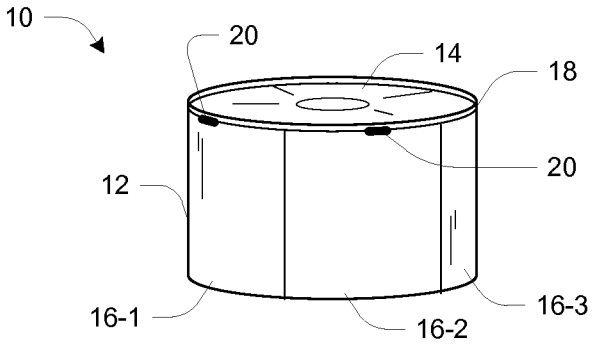
FIG. 1 is a perspective view of a warhead with peripheral segments in folded positions as at launch.

FIG. 1 shows a warhead 10 (also referred to as "submunition" herein) having a cylindrical body 12 closed at one end by a disk-shaped liner 14. The body 12 is generally of steel or a similar hard, high-strength material, while the liner 14 is of a denser and more deformable material such as copper. The body 12 is divided into multiple peripheral segments 16 (shown as 16-1, 16-2 etc.) about the axis of the warhead 10. In the illustrated example, four peripheral segments 16 are used, with three segments 16-1, 16-2 and 16-3 being visible in FIG. 1. Each peripheral segment 16 is secured to a central segment 18 by a respective hinge 20. Both the peripheral segments 16 and central segment 18 are hollow members having internal cavities filled with high explosive. One or more detonators (not shown in FIG. 1) are used to detonate the explosive when the warhead 10 comes into range of a target. As described more fully below, detonation forms both an explosively formed penetrator (EFP) slug from liner 14 as well as a number of smaller fragments. The warhead 10 may be used in two basic configurations. In the configuration shown in FIG. 1, the main effect is that of the EFP formed by liner 14, which can be used against harder point targets such as armored vehicles. In another configuration described below, a somewhat diminished EFP effect is accompanied by a hail of fragments forming smaller projectiles, usable against softer and/or area targets such as light vehicles and personnel. The first configuration, shown in FIG. 1, is referred to herein as the "closed" or "folded" configuration or position, while the second configuration is described below and is referred to as the "open" or "unfolded" position.

Figure 2:
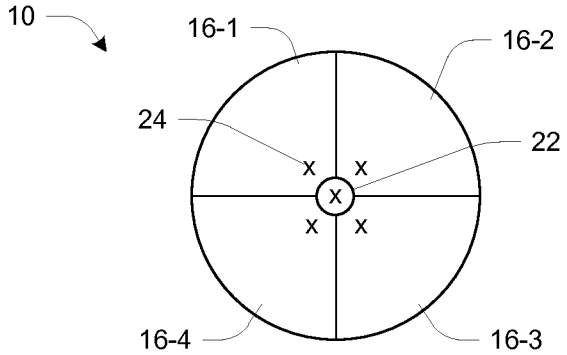
FIG. 2 is a schematic rear view of the warhead.

FIG. 2 is a schematic view of the bottom of the warhead 10. Triangular-shaped bottom surfaces of the four peripheral segments 16 are shown. As described more fully below, the central segment 18 has a cone shape, broad at the top and narrow at the bottom, while the peripheral segments 16 have complementary annular-section or wedge shapes having triangular radial cross section. Shown schematically is a latch 22 used to maintain the warhead 10 in the closed or folded configuration, the latch being disengaged during operation to enable the peripheral segments 16 to rotate about the hinges 20 to the open position. Also indicated schematically are respective detonation points 24 for the segments 16, 18. There may be distinct detonators (not shown) used for respective segments 16, 18, or in an alternative embodiment there may be fewer detonators (e.g., one) coupled to the detonation points 24 by detonation cord for example.

Figure 3:
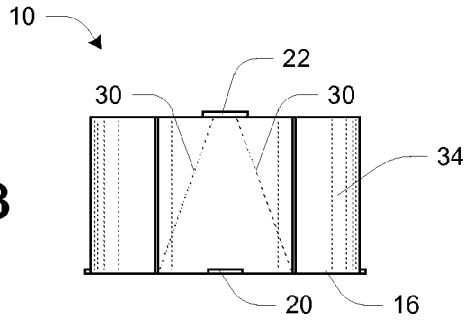
FIGS. 3-5 are views of the warhead from different angles and with peripheral segments in both folded and open positions.
Figure 4:
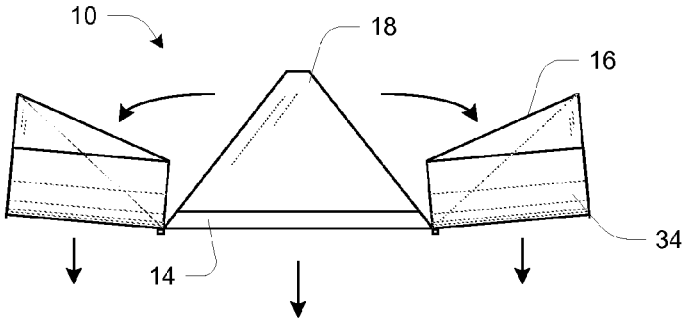

FIGS. 3 and 4 are side views illustrating the opening of the warhead 10 during operation. FIG. 3 shows the warhead 10 in the closed position, as in FIGS. 1 and 2. The dotted lines 30 indicate inward-facing surfaces of the wedge-shaped peripheral segments 16, which abut the rear conical surface of the central segment 12. When the peripheral segments 16 are in the closed position, the curved outer surfaces 34 of the peripheral segments 16 together form the cylindrical sidewall of the warhead 10.

FIG. 4 shows the warhead 10 in the open position, in which the peripheral segments 16 have rotated approximately 90 degrees so that their respective curved outer surfaces 34 are facing in the same forward direction as the liner 14. Only two of the peripheral segments 16 are shown; it will be appreciated that the other two peripheral segments 16 open in directions out of the plane of FIG. 4.

Figure 5:
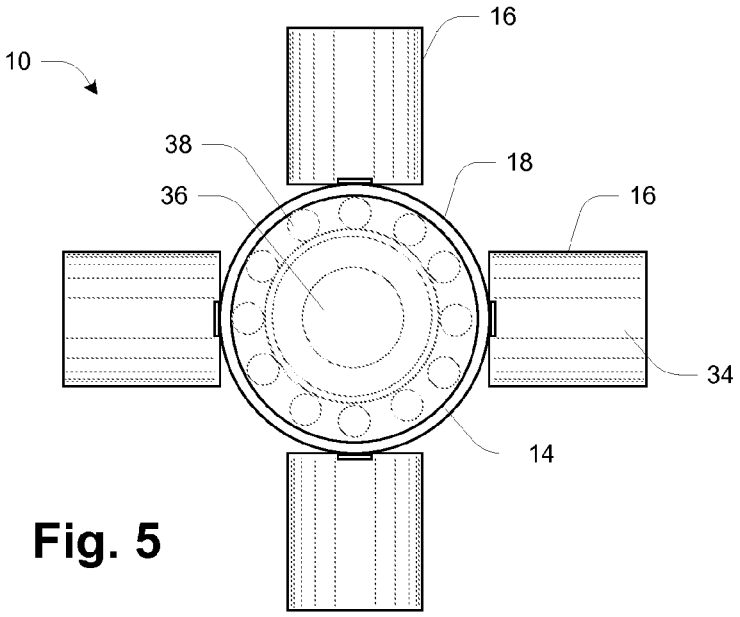

FIG. 5 shows a front view of the warhead 10 in the open position as in FIG. 4. All four peripheral segments 16 are shown. Also shown is a particular patterning of the liner 14, specifically a central depression 36 and a ring of surrounding smaller depressions 38. This patterning promotes a predetermined fragmentation of the liner 14 upon detonation to achieve a desired effect. Specifically, the center portion of the liner 14 forms a relatively large EFP slug as for other types of EFP warheads. The outer ring of depressions 38 fragments into smaller projectiles which can be effective against personnel and light vehicles. When the warhead 10 is detonated in the open position as in FIG. 5, this latter effect is increased by forward-directed fragments created from the walls 34 of the peripheral segments 16.

In general, the warhead 10 may be detonated in either the folded (closed) or open position. In some embodiments, the manner of use may be fixed, while in other embodiments it may be user-selectable in some manner. As an example of a fixed use, the latch 22 may be non-releasable or even replaced by other structure to fixedly retain the peripheral segments 16 in the closed position, such as by screws or similar fasteners or even welding. In this embodiment the warhead 10 may be used in the same manner as a conventional EFP warhead. The explosion of the peripheral segments 16 acts to confine the explosion of the central segment 18, increasing the velocity and effectiveness of the slug and any other projectiles formed by the liner 14. This kind of use may also be selected, for example by simply refraining from unlatching or releasing the peripheral segments 16 prior to detonation.

If the manner of use is selectable, then a variety of control schemes for detonation with or without release of the peripheral segments 16 to the open position may be used. As noted, when a releasable latch 22 is used, in a given application it may not be activated, so that the warhead 10 is detonated with the peripheral segments 16 retained in the folded position of FIG. 3. The detonator and latch 22 may also be configured to initiate detonation of the warhead 10 with the peripheral segments 16 in the open position after release by the latch 22. In this case the projectiles formed by fragmentation of the outer surfaces 34 of the peripheral segments 16 are directed forward toward the target, enhancing effectiveness against lighter equipment and/or personnel. Selection and timing of the position of detonation may be made in a variety of ways. In one case, electronic control circuitry carried by the warhead controls operation. The circuitry may be programmed or otherwise instructed to use particular timing and/or conditions for releasing the latch 22 to attain the open position for detonation. In one example, the release may be enabled by user input prior to launch of the warhead 10 toward a target, which may be effective when the user knows the characteristics of the target prior to launch. Alternatively, the release may be enabled at a time of target acquisition by automatic action of the control circuitry carried by the warhead. This configuration can increase effectiveness when the exact characteristics of the target are not known at launch but can be ascertained by the control circuitry based on sensor input (e.g., visible-light or infrared imaging input).

The outer surfaces 34 of the peripheral segments 16 may be specifically configured to achieve a desired fragmentation into projectiles of predetermined size and shape upon detonation of the warhead 10. For example, the surfaces 34 may be scored with a pattern of lines. Alternatively, a relief pattern of thickness variation may be used, such as dimpling, analogous to the above-described depressions 38 of the liner 14.

Figure 6:
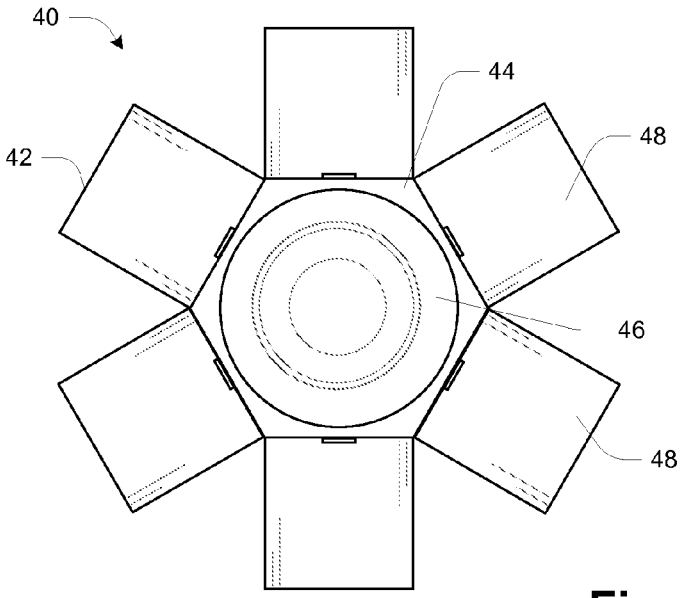
FIG. 6 is a view of a warhead according to an alternative embodiment.

FIG. 6 shows an alternative embodiment 40 employing six peripheral segments 42 along with a central segment 44 having a hexagonal-shaped forward end 44. The peripheral segments 42 have the same general shape as the peripheral segments 16 of FIGS. 1-5, but their outer surfaces 48 are flat rather than curved. In the closed position the warhead 40 is cylindrical with a hexagonal cross section. It will be appreciated that in alternative embodiments other polygonal cross-sectional shapes may be utilized.

Figure 7:
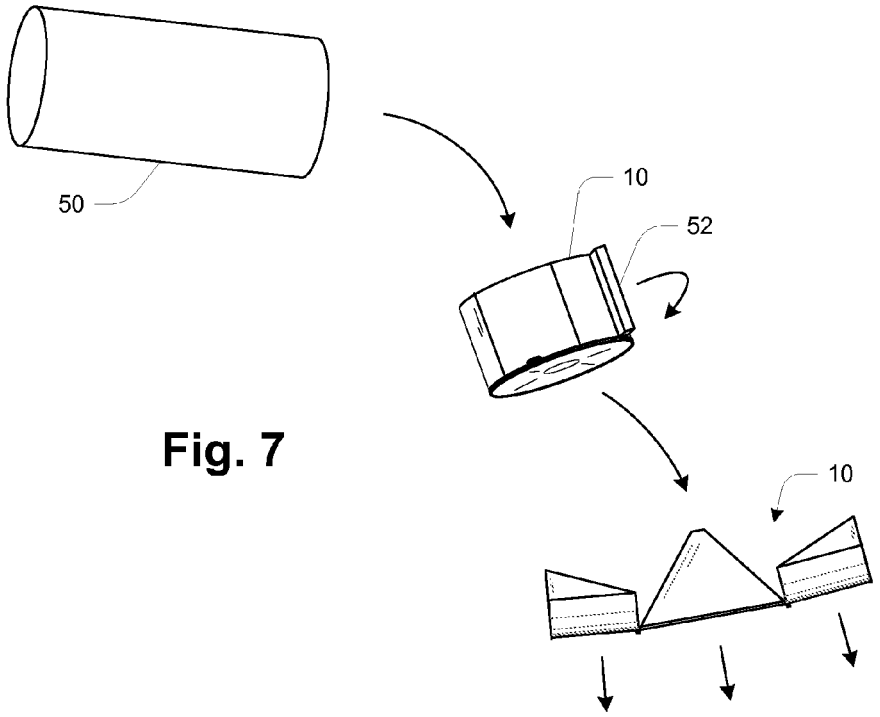
FIG. 7 is a schematic diagram depicting use of the warhead.

FIG. 7 illustrates one manner of deployment of a warhead 10 or 40 (identified as 10 for ease of description). A set of multiple warheads 10 may be stacked in a cylindrical canister 50 that can be launched from an airborne vehicle. The individual warheads 10 are ejected from the canister 50 above an area of a target. As a warhead 10 is ejected, a spinning motion is imparted to it by suitable means, examples of which are described below. As the warhead 10 is spinning and falling towards a target, sensing circuitry 52 detects the target and initiates the opening and detonation of the warhead 10 in a desired manner. The warhead is opened 10 by releasing the latch 22, causing the peripheral segments 16 to rotate on the hinges 20 under effect of centrifugal force created by the spinning motion. Once the peripheral segments 16 are in the fully open position, the warhead 10 is detonated.

Munition spin can be achieved using a small rocket motor with canted nozzles. Other techniques could be used including aerodynamic spin-up or gun-firing induced spin for example, depending on the type of delivery system in use. In a weapon system known as SADARM, an artillery round is used which carries several EFP-like munitions. In that case the artillery projectile is spun up during launch and the munitions are ejected over the target while the artillery projectile is still spinning. In this kind of system the spin rate may be intentionally decreased after firing, using a vortex parachute for example, to a lower rate for scan and fire phase. In one embodiment, the munition could attain the erected or open state during such a lowered spin rate while hanging on a parachute. The mode of operation may depend on how and when a target is identified as a soft target versus a hard target in a given application, as the geometric transformation would be made at or after that time. It could be that the decision about which configuration to use is made even before the artillery projectile is launched. If that is normally the case, then the transformation might occur during a higher spin rate phase, such as during parachute deployment in SADARM-style systems for example.

While various embodiments of the invention have been particularly shown and described, it will be understood by those skilled in the art that various changes in form and details may be made therein without departing from the spirit and scope of the invention as defined by the appended claims.

What is claimed is:

1. A warhead, comprising:

a conical central segment having a disk-shaped liner at a front end, the liner bounding a cavity of the central segment filled with high explosive, the liner configured to form one or more high-speed projectiles in a forward direction upon detonation of the high explosive;

a plurality of peripheral segments hingedly attached to the central segment about the liner at the front end, each peripheral segment having an outer segment face bounding a cavity of the peripheral segment filled with high explosive, the segment faces of the peripheral segments forming sidewall portions of the warhead when the peripheral segments are in a folded position, the peripheral segments being operable to be released from the folded position to an open position in which the segment faces are pointed in the forward direction for detonation; and a detonator operative to initiate simultaneous detonation of the high explosive of the central and peripheral segments.

2. A warhead according to claim 1, having a cylindrical shape defined by the segment faces of the peripheral segments when the peripheral segments are in the folded position.

3. A warhead according to claim 2, wherein the segment faces are curved to define a circular cross section of the warhead when the peripheral segments are in the folded position.

4. A warhead according to claim 2 wherein the segment faces are flat to define a polygonal cross section of the warhead when the peripheral segments are in the folded position.

5. A warhead according to claim 4, wherein the number of peripheral segments is six and the polygonal cross section is a hexagonal cross section.

6. A warhead according to claim 1, including a latch operable to release the peripheral segments from the folded position to enable the peripheral segments to move to the open position.

7. A warhead according to claim 6, wherein the detonator and latch are mutually configured to initiate detonation of the warhead with the peripheral segments retained in the folded position by the latch.

8. A warhead according to claim 7, wherein the peripheral segments have wedge-shaped cross sections so as to abut a rear conical surface of the central segment when in the folded position.

9. A warhead according to claim 6, wherein the detonator and latch are mutually configured to initiate detonation of the warhead with the peripheral segments in the open position after release by the latch.

10. A warhead according to claim 9, wherein the warhead is operable to spin about a forward-pointing axis prior to detonation, the spinning sufficient to move the peripheral segments from the folded position to the open position by centrifugal force after release by the latch.

11. A warhead according to claim 9, wherein the release of the peripheral segments by the latch prior to detonation is enabled at a time of use of the warhead.

12. A warhead according to claim 11, wherein the release is enabled by user input prior to launch of the warhead toward a target.

13. A warhead according to claim 11, wherein the release is enabled at a time of target acquisition by automatic action of control circuitry carried by the warhead.

14. A warhead according to claim 1, wherein the liner is configured to form a central penetrating slug and a plurality of surrounding smaller projectiles upon detonation of the warhead.

15. A warhead according to claim 1, wherein the segment faces of the peripheral segments are configured for fragmentation into projectiles of predetermined size upon detonation of the warhead.

16. A warhead according to claim 15, wherein the configuration for fragmentation includes scoring of the segment faces.

17. A warhead according to claim 15, wherein the configuration for fragmentation includes dimple patterning of the segment faces.

* * * * *